US006679236B2

(12) United States Patent
Skinner et al.

(10) Patent No.: US 6,679,236 B2
(45) Date of Patent: Jan. 20, 2004

(54) IGNITION SYSTEM HAVING A HIGH RESISTIVITY CORE

(75) Inventors: Albert Anthony Skinner, Anderson, IN (US); James Alva Boyer, Anderson, IN (US); Raymond O. Butler, Jr., Anderson, IN (US)

(73) Assignee: Delphi Technologies, Inc., Troy, MI (US)

( * ) Notice: Subject to any disclaimer, the term of this patent is extended or adjusted under 35 U.S.C. 154(b) by 140 days.

(21) Appl. No.: 09/977,009

(22) Filed: Oct. 12, 2001

(65) Prior Publication Data

US 2003/0070664 A1 Apr. 17, 2003

(51) Int. Cl.[7] ..... F02P 1/00
(52) U.S. Cl. ..... 123/634; 123/635
(58) Field of Search ..... 123/634, 635; 336/96

(56) References Cited

U.S. PATENT DOCUMENTS 4,105,007 A * 8/1978 Mochimaru ..... 123/634
4,846,129 A 7/1989 Noble ..... 123/425
5,706,792 A 1/1998 Boyer et al. ..... 123/634
5,909,086 A * 6/1999 Kim et al. ..... 315/111.21
5,947,093 A * 9/1999 Ward ..... 123/598
6,033,565 A * 3/2000 Van Heesch et al. ..... 210/243
6,112,730 A * 9/2000 Marrs et al. ..... 123/606
6,135,099 A 10/2000 Marrs et al. ..... 123/606
6,142,130 A 11/2000 Ward ..... 123/606
6,194,884 B1 2/2001 Kesler et al. ..... 323/285

* cited by examiner

*Primary Examiner*—John Kwon
(74) *Attorney, Agent, or Firm*—Jimmy L. Funke

(57) ABSTRACT

An ignition apparatus includes a high resistivity ferrite central core with a secondary winding disposed directly thereon. The ignition apparatus also includes, in a progressively coaxial fashion, a primary spool, a primary winding disposed on the spool, a case, and an outer core or shield of magnetically permeable material. The ignition apparatus exhibits reduced capacitance, and eliminates radial partial discharge at the inside diameter of the secondary winding.

12 Claims, 3 Drawing Sheets

IGNITION SYSTEM HAVING A HIGH RESISTIVITY CORE

BACKGROUND OF THE INVENTION

1. Technical Field

The present invention relates generally to ignition systems for internal combustion engines, and, more particularly, to an ignition system having a high resistivity core.

2. Description of the Related Art

There has been much investigation related to ignition systems for providing a spark to a combustion chamber of an internal combustion engine, as seen by reference to U.S. Pat. No. 5,706,792 issued to Boyer et al. entitled "INTEGRATED IGNITION COIL AND SPARK PLUG." Boyer et al. disclose an ignition coil of the type having relatively slender dimensions suitable for being disposed in a spark plug access well, commonly referred to as a "pencil" coil. Boyer et al. disclose an apparatus having inherent capacitive and inductive characteristics adapted for attenuation of radio frequency interference (RFI). The apparatus of Boyer et al. includes a central core, primary and secondary coils, and an outer core or case formed of magnetic material, all coaxially arranged. While Boyer et al. teach configuring the capacitance characteristics of the ignition coil to control RFI, the capacitance associated with the ignition coil presents designers and engineers with challenges, particularly in a so-called multicharge system (i.e., delivery of multiple or repetitive sparks for a single combustion event).

One challenge involves controlling a phenomenon known in the art as a spark-on-make, or a pre-ignition condition, which is undesirable. The higher the capacitance of the ignition coil, the greater is the lead time required to charge the ignition coil. The increased charge time requires that coil charging be started earlier relative to top dead center (TDC), where pressures in the combustion chamber are reduced and therefore a voltage level required to break down a spark plug gap is also reduced. If left uncontrolled, the situation described above may increase the probability of an undesirable pre-ignition condition. Another challenge involves controlling large voltages that are produced during operation, due to leakage inductance and the like. In particular, when a primary driver coupled to a primary winding is shut off (i.e., when a spark is desired), a relatively large reflected or reverse EMF is established, for example, at a collector terminal of the driver (e.g., if it is an IGBT). As a result, a relatively expensive, and large clamp device (e.g., diode) must be used. Additionally, often a high voltage diode is used in the secondary winding circuit to block any possible spark current from flowing due to a make voltage. These high voltage devices increase cost and are large. Ignition coil capacitance bears on the selection of these devices as follows.

For a multicharge ignition coil, the level of energy that is required to be stored is proportional to the capacitance of the ignition coil itself. Applicants have determined for this invention it would therefore be desirable to lower the energy required so that a charge time can be reduced. Reducing the charge time would allow the ignition coil to be turned on closer to top dead center (TDC), where the pressures are greater, and a voltage level required to break down a spark plug gap is therefore greater. The increased gap breakdown levels would permit increased ignition on make voltages to be produced before undesirable early sparking can occur. The foregoing would allow an ignition coil design having an increased turns ratio (i.e., secondary winding $N_S$ to primary winding $N_P$). Such an increased turns ratio would reduce reflected voltages, allowing a reduced voltage clamp device on the driver, which would reduce cost and size.

Still another problem with conventional pencil type ignition coils involves dielectric failure, particularly where the ignition coil is of the type where a secondary winding is wound on a secondary spool. Physical separations (i.e., small voids) between the inside of the secondary winding and an outer surface of the secondary spool allow for radial partial discharges across this gap. The discharges actually remove dielectric material. This process of removal continues to grow in a tree pattern, eventually permitting a short to occur. The short will fail the ignition coil, which reduces the effective service life of the product, and may increase warranty returns.

U.S. Pat. No. 6,135,099 to Marrs et al. disclose an ignition system with a transformer having an AC output connected to a spark plug with a ferrite core. Marrs et al., however, do not teach that the core is of high resistivity nor that the overall arrangement is configured to reduce capacitance.

There is therefore a need for an ignition system that addresses one or more of the challenges or minimizes or eliminates one or more of the problems set forth above.

SUMMARY OF THE INVENTION

One object of the present invention is to provide a solution to one or more of the problems or address one or more of the challenges set forth above.

One advantage of the present invention is that it provides a reduced capacitance compared to conventional ignition coils. Accordingly, a charge time is correspondingly reduced, thereby allowing charging of the ignition coil to begin closer to top dead center, where combustion chamber pressures are increased and the voltage level needed to break down the spark plug gap is also increased, thereby reducing the chance of a spark-on-make condition. Additionally, the increased voltage level permitted before a spark over can occur allows an increased turns ratio which, in turn, results in a lower reflected voltage being produced and impressed on the driver associated with the ignition coil. The reduced reflected voltage allows a reduced voltage rating for clamp circuitry or devices, which reduces cost and size.

Still another advantage of the invention relates to the reduced capacitance of the ignition coil per se, which results in a reduced level of stored energy. This provides greater flexibility over spark control during a combustion event, particularly for multicharging. Yet another advantage according to a preferred embodiment of the invention relates to improved efficiency. In such a preferred embodiment, the central core comprises high resistivity ferrite material, which exhibits reduced eddy current losses compared to, for example, conventional steel laminations. The reduced losses result in an improved overall system efficiency. Still yet another advantage according to such a preferred embodiment of the invention involves a reduced manufacturing cost compared to, for example, conventional steel laminations.

These and other objects and advantages are achieved by an ignition apparatus of the coil-on-plug type configured to be disposed in a spark plug access well. The ignition apparatus includes a central core, a primary winding, and a secondary winding wound on the core having an end (e.g., a high voltage end) coupled to a connector. The connector is configured for connection to a spark plug. In accordance with the invention, the central core is formed of high resistivity ferrite material, which reduces the ignition coil capacitance, as described in greater detail herein.

An ignition system, and a method of operating an ignition coil are also presented.

DETAILED DESCRIPTION OF THE PREFERRED EMBODIMENTS

Figure 1:
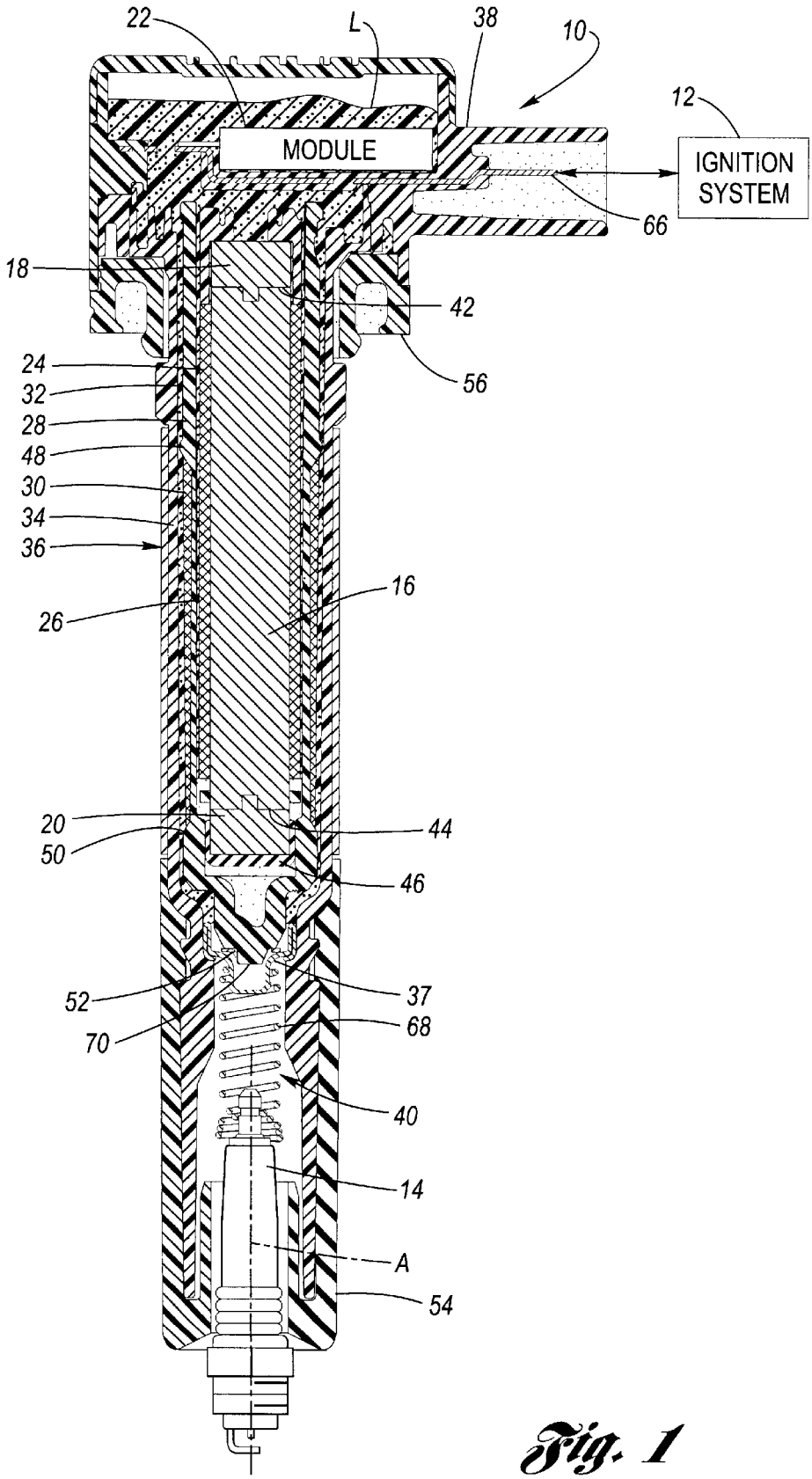
FIG. 1 is a sectional view of a preferred embodiment of an ignition coil according to the present invention.

Referring now to the drawings wherein like reference numerals are used to identify identical components in the various views, FIG. 1 is a simplified, cross-section view of an ignition apparatus or coil 10 in accordance with the present invention. As is generally known, ignition apparatus 10 may be coupled to, for example, an ignition system 12, which contains circuitry for controlling the charging and discharging of ignition apparatus 10. Further, also as is well known, the relatively high voltage produced by ignition apparatus 10 is provided to a spark plug 14 (shown in phantom-line format) for producing a spark across a spark gap thereof defined by spaced electrodes 13 and 15. The spark, of course, may be employed to initiate combustion in a combustion chamber of an internal combustion engine. Ignition system 12 and spark plug 14 perform conventional functions well known to those of ordinary skill in the art.

Ignition apparatus 10 is adapted for installation to a conventional internal combustion engine through a spark plug access well onto a high-voltage terminal of spark plug 14. Spark plug 14 may be retained by a threaded engagement with a spark plug opening in the above-described combustion chamber. The engine may provide power for locomotion of a vehicle, such as an automotive vehicle.

FIG. 1 further shows a central core 16, an optional first magnet 18, an optional second magnet 20, an electrical module 22, a secondary winding 24, a first layer of encapsulant such as epoxy potting material 26, a primary spool 28, a primary winding 30, a second layer 32 of encapsulant, such as epoxy potting material, a case 34, an outer core or shield assembly 36, an electrically conductive cup 37, a low-voltage (LV) connector body 38, and a high-voltage (HV) connector assembly 40. Core 16 is characterized by a first, top end 42, and a second, opposing bottom end 44. FIG. 1 further shows a rubber buffer cup 46, annular projections 48, 50, a high voltage terminal 52, a boot 54, and a seal 56.

As described in the Background, one failure mode for a conventional pencil coil results from a radial partial discharge at an inside diameter of the secondary winding, between the secondary winding and an outer winding surface of the secondary spool. The principal reason for such failure is because of gaps due to separations (i.e., voids or air gaps) between the windings and the spool, over which radial partial discharges can occur. In accordance with the present invention, core 16 is formed, in a preferred embodiment, using a high resistivity ferrite material. Ferrites, as known, are a chemical composition of various metallic oxides (e.g., nonmetals). Ferrites are magnetically permeable, which may concentrate and reinforce a magnetic field. Ferrites also have a relatively high electrical resistivity, which limits the amount of flow of electrical current. In contrast, for example, a conventional central core formed of silicon steel laminations being formed of metal is highly electrically conductive, permitting electrical current to flow.

In a preferred embodiment, a class of ferrites known as nickel zinc ferrites possess the desired, high level of electrical resistivity. Preferably, the level of resistivity may vary between about $1\times10^7$ and $1\times10^9$ Ω-cm, more preferably between about $1\times10^8$ and $1\times10^{10}$ Ω-cm, and may be approximately $1\times10^9$ Ω-cm in a preferred embodiment.

Core 16 may be elongated, having a main, longitudinal axis designated "A" associated therewith. Core 16, in the preferred embodiment, takes a generally cylindrical shape (i.e., generally circular shape in radial cross-section).

Figure 2:
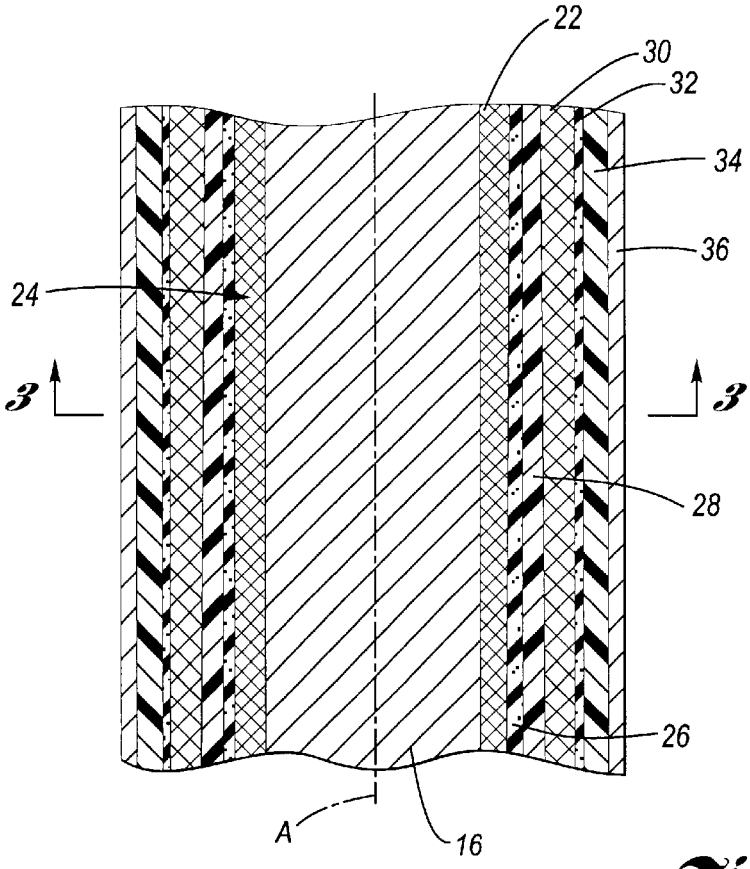
FIG. 2 is an enlarged section view of a portion of the ignition coil of FIG. 1.

FIG. 2 shows a central portion of the ignition apparatus 10 of FIG. 1 in greater detail. As shown, secondary winding 24 is disposed directly on central core 16. Primary winding 30, in contrast, is disposed radially outwardly of secondary winding 24, and is wound on primary spool 28. Central core 16, secondary winding 24, primary spool 28, primary winding 30, case 34, and shield assembly 36 are arranged substantially coaxially with respect to axis A. Secondary winding 24 includes a low voltage end and a high voltage end. The low voltage end may be connected to a ground by way of a ground connection, for example, through LV connector body 38 (best shown in FIG. 1) in a manner known to those of ordinary skill in the art. The high voltage end is connected to HV terminal 52 (best shown in FIG. 1). In a preferred embodiment, a segmented/angle type winding approach may be employed for forming secondary winding 24, which results in substantially the same voltage on both the radially inside and radially outside portions of the secondary winding. Since there is no radial voltage gradient across the secondary windings in this embodiment, radial partial discharge is eliminated. In addition, since there is substantially no voltage gradient there is no effective capacitance on the inside of the secondary winding 24. In contrast, the capacitance distributed on the inside of the secondary winding, in a conventional arrangement (i.e., where the secondary winding is wound on a secondary winding spool) accounts typically for 30–40% of the total capacitance. Eliminating this capacitance, as does the present invention, reduces the required stored energy by about the same amount. In an alternate embodiment, a layer wound approach may be taken for secondary winding 24. In such an arrangement, the high voltage exists on a radially inner portion of the secondary winding, which, in any event, is in direct contact with the high resistivity ferrite core 16. The high resistivity of core 16 inhibits current flow along the surface of the core, in view of an axial voltage gradient.

Figure 3:
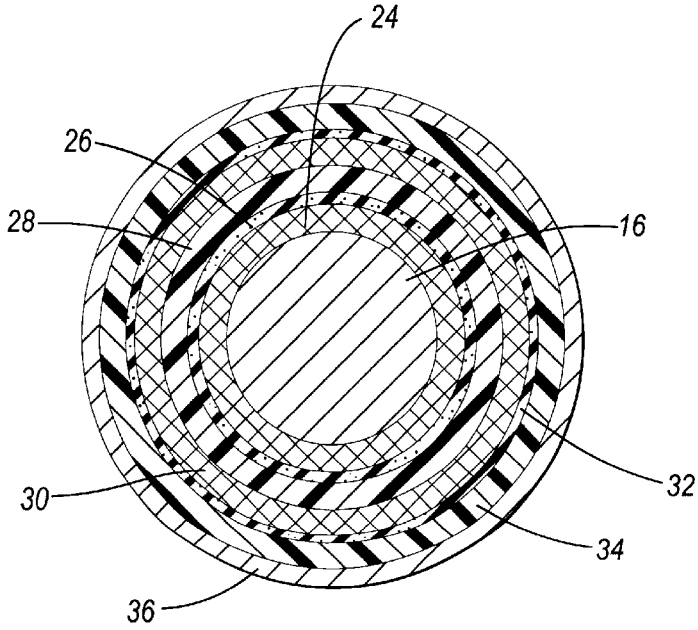
FIG. 3 is a section view of the ignition coil in FIG. 2 taken substantially along lines 3—3.

FIG. 3 is a radial section view of apparatus 10 taken substantially along lines 3—3 of FIG. 2.

Figure 4:
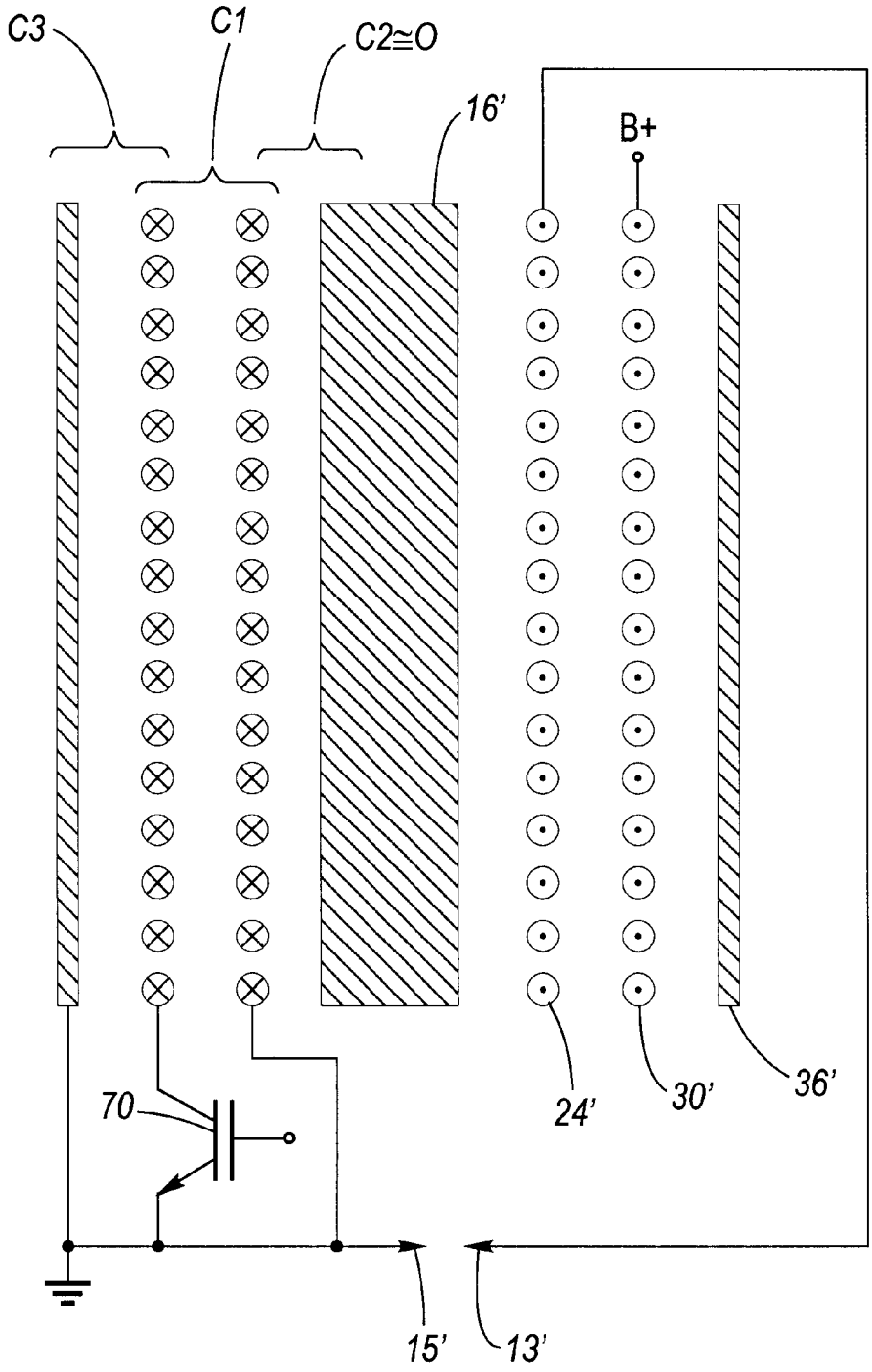
FIG. 4 is a simplified schematic and diagrammatic view of an equivalent electrical circuit of the ignition coil in FIG. 1.

With reference to FIG. 4, the embodiment of the invention illustrated in FIGS. 1–3 is shown in a simplified schematic form. The electrical magnetic circuit elements are labeled with reference numerals having a prime designation that matches the corresponding features of FIG. 1 (e.g., core 16 in FIG. 1 is labeled 16' in FIG. 4, etc.). Core 16' is illustrated as being surrounded, in a progressive coaxial fashion, by secondary winding 24', primary winding 30', and outer core 36'. The low voltage end of primary winding 30' is shown connected to a system voltage, labeled B+. The B+ coupling may be made through LV connector body 38. The other end of primary winding 30' is selectively connected to a ground node by way of a controllable switch 70, such as a semiconductor switching transistor. Switch 70 is controlled in a well known manner in accordance with predetermined ignition timing strategies for each cylinder by ignition system 12, responsive to sensed angles of engine rotation, for example, as generally known in the art.

Note that the secondary winding 24' and the primary winding 30', capacitively couple one with the other, the equivalent capacitance being labeled C1 in FIG. 4. In addition, the primary winding 30' and the outer core 36' also capacitively couple one with the other, the equivalent capacitance being labeled C3 in FIG. 4. Finally, it bears emphasizing that, according to the invention, an equivalent capacitance between the secondary winding 24', and central core 16' is effectively zero. This is in contrast to conventional designs, which exhibit a positive capacitance value for each one of C1, C2, and C3. Thus, an ignition coil according to the invention presents a reduced capacitance. The level of energy that is required to be stored is directly proportional to the capacitance of the coil itself. Reducing the capacitance results in a reduced energy storage requirement, thereby reducing a charge time to charge the ignition coil. Reduction of the charge time allows ignition coil 10 to be turned on (i.e., the start of charging to reach a desired primary current) closer to top dead center (TDC), where combustion chamber pressures are greater, and a voltage level required to break down the spark plug gap between spaced electrodes 13 and 15 is greater. The increased break down voltage therefore allows ignition coil 10 to have an increased turns ratio, without a significantly increased risk of a spark-on-make condition. As a result of the increased turns ratio, a lower clamp voltage may be possible, which reduces the size, and cost thereof for the associated clamp device associated with driver 70.

Another feature of a high resistivity ferrite core according to the invention is that circulating electrical currents, known as eddy currents, are reduced. Eddy currents, as known, are converted into heat, resulting in overheating and reduced efficiency. Ferrites enjoy low energy losses, and are therefore highly efficient. The reduction in losses in core 16, therefore, result in an overall increased efficiency of ignition coil 10. It should be appreciated that while ferrites have a relatively high resistivity, they tend to have a reduced saturation flux density (i.e., as compared to steel laminations). Therefore, while the reduced capacitance results in reduced energy storage, a corresponding reduction in size may not be fully realized (i.e., need greater core volume to compensate). In accordance with another aspect of the present invention, however, in a multicharging arrangement (i.e., where multiple sparks are initiated for a single combustion event), use of the present invention is particularly well suited, since the level of stored energy that is required is reduced relative to that for single spark ignition coils. In a multicharging pencil coil, according to the invention, therefore, any increases in size due to a reduced saturation flux density of ferrite, can easily be accommodated, and still fit within the relatively reduced dimensions of a spark plug access well.

In another embodiment, the ferrite core is provided with a hole through the center. A composite iron core ("secondary central core") would be inserted into the hole. This way for the initial charge you would have the high inductance associated with the high permeability of the ferrite core, and when it saturates the composite iron core would continue to carry increasing amounts of flux at a lower permeability. This would reduce the change in inductance above the point where the ferrite saturates. This would allow more energy to be stored while keeping the benefits associated with the original all ferrite core.

Core 16 may be manufactured by forming a slurry containing the ferrite material, which is then compacted into a desired form, and is then fired (i.e., heated for a predetermined time at a predetermined temperature or through a temperature profile). Core 16, accordingly, presents manufacturing advantages compared to conventional approaches for producing a central core 16 in ignition coil 10 (e.g., steel laminations). In such conventional ignition coils, a machine must make a plurality of different size, individual steel laminations, which are then adhered together to form the core. In one embodiment, core 16 of the present invention exhibits a two to three times cost savings relative to a conventional steel lamination core.

Referring again to FIG. 1, further details concerning ignition apparatus 10 will now be set forth to enable one of ordinary skill to practice the present invention. It should be understood that portions of the following are exemplary only and not limiting in nature. Many other configurations are known to those of ordinary skill in the art and are consistent with the teachings of the present invention.

Magnets 18 and 20 may be included in ignition apparatus 10 as part of the magnetic circuit, and to provide a magnetic bias for improved performance. The construction of magnets, such as magnets 18 and 20, as well as their use and effect on performance, is well understood by those of ordinary skill in the art. It should be understood that magnets 18 and 20 are optional in ignition apparatus 10, and may be omitted, albeit with a reduced level of performance, which may be acceptable, depending on performance requirements.

Electrical module 22 includes primary energization circuitry, such as switch 70, for selectively connecting primary winding 30 to ground. Switch 70 may comprise an insulated gate bipolar transistor (IGBT) or the like.

Primary winding 30 may be wound directly on primary spool 28 in a manner known in the art. Primary winding 30 includes first and second ends and is configured to carry a primary current $I_P$ for charging ignition apparatus 10 upon control of ignition system 12. Winding 30 may be implemented using known approaches and conventional materials. Primary spool 28, accordingly, is configured to receive and retain primary winding 30. Spool 28 is disposed adjacent to and radially outwardly of the central components comprising core 16, secondary winding 24, and epoxy potting layer 26, and, preferably, is in coaxial relationship therewith. Spool 28 may comprise any one of a number of conventional spool configurations known to those of ordinary skill in the art. In the illustrated embodiment, spool 28 is configured to receive a continuous primary winding on an outer surface thereof. The spool 28 may be formed generally of electrical insulating material having properties suitable for use in a relatively high temperature environment. For example, spool 28 may comprise plastic material such as PPO/PS (e.g., NORYL available from General Electric) or polybutylene terephthalate (PBT) thermoplastic polyester. It should be understood that a variety of alternative materials may be used for spool 28 known to those of ordinary skill in the ignition art, the foregoing being exemplary only and not limiting in nature.

Spool 28 may further include first and second annular features 48 and 50 formed at axially opposite ends thereof. Features 48 and 50 may be configured to locate, align and center spool 28 in a cavity of case 34.

A rubber buffer cup 46 may also be included.

Layers 26 and 32 comprise an encapsulant suitable for providing electrical insulation within ignition apparatus 10.

In a preferred embodiment, the encapsulant comprises epoxy potting material. The epoxy potting material introduced in layers 26 and 32 may be introduced into annular potting channels defined (i) between secondary winding 24 and primary spool 28, and, (ii) between primary winding 30 and an inner surface of case 34. The potting channels are filled with potting material, in the illustrated embodiment, up to approximately the level designated "L" in FIG. 1. A variety of thicknesses of the layers 26 and 32 may be possible depending on the dimensions of the components of ignition coil 10, as well as the flow characteristics and desired insulating characteristics to be achieved through the use of the encapsulant. The potting material further provides protection from environmental factors which may be encountered during the service life of ignition apparatus 10. There are a number of suitable epoxy potting materials well known to those of ordinary skill in the art.

Case 34 is formed of electrical insulating material, and may comprise conventional materials known to those of ordinary skill in the art (e.g., the PBT thermoplastic polyester material referred to above).

Shield assembly 36 is generally annular in shape and is disposed radially outwardly of case 34, and, may engage an outer surface of case 34. The shield 36 preferably comprises magnetically permeable, electrically conductive material, and, more preferably metal, such as silicon steel or other adequate magnetic material. Shield 36 provides not only a protective barrier for ignition apparatus 10 generally, but, further, provides a return magnetic path for the magnetic circuit portion of ignition apparatus 10. Shield 36 may be grounded by way of an internal grounding strap, finger, or the like (not shown) or in other ways known to those of ordinary skill in the art. Shield 36 may comprise multiple, individual sheets, also as shown.

Connector body 38 is configured to, among other things, electrically connect the low voltage end of primary winding 30 to a power source, such as B+, as well as providing an electrical ground reference to ignition coil 10. Connector body 38 is further configured to receive an electronic spark timing (EST) signal from ignition system 12, which controls conduction of switch 70 (i.e., when and for how long). Connector body 38 is generally formed of electrical insulating material, but also includes a plurality of electrically conductive output terminals 66 (e.g., pins for ground, power source, spark timing signal, etc.). Terminal 66 are coupled electrically, internally, through connector body 38 via a lead frame, for example, to electrical module 22, in a manner known to those of ordinary skill in the art.

HV connector assembly 40 may include a spring contact 68 or the like, which is electrically coupled to cup 37. Contact spring 68 is in turn configured to engage a high-voltage connector terminal of spark plug 14. This arrangement for coupling the high voltage developed by secondary winding 24 to spark plug 14 is exemplary only; a number of alternative connector arrangements, particularly spring-biased arrangements, are known in the art.

An ignition apparatus in accordance with the present invention includes a high resistivity ferrite core with a secondary winding disposed directly thereon. This arrangement significantly reduces the capacitance of the ignition coil. The reduced capacitance results in several advantages. First, reducing the capacitance also reduces an associated charge time, allowing the ignition coil to be turned on closer to top dead center (TDC), where combustion chamber pressures are greater, and the voltage levels required to break down the spark gap are also increased. The increased break down voltage levels allows for an increased turns ratio (i.e., secondary winding: primary winding), which results in a lower reflected voltage on an output driver device. This permits use of a clamp device (e.g., diode having a reduced voltage rating). This reduces both the cost and size of the clamp device for the driver (e.g., device 70). Second, decreased charge time yields a multicharge ignition system having greater flexibility in energy delivery. Third, system efficiency is improved inasmuch as eddy current losses in a ferrite core are reduced relative to conventional core arrangements (e.g., steel laminations), particularly in the 10–20 kHz region. The reduced energy losses due to reduced eddy current losses allows an ignition coil 10 to have an even further reduced energy storage requirement (i.e., reduced even beyond that resulting from the reduced capacitance by eliminating the secondary winding spool). Fourth, the core material provides cost advantages compared to laminations, which are relatively expensive to manufacture. Fifth, the above-mentioned core/secondary winding arrangement eliminates radial partial discharge along the inside diameter portion of the secondary winding, thereby yielding increased robustness, with increased options for encapsulation, which may also allow a cost reduction. Eliminating the radial partial discharge reduces product failures.

It is to be understood that the above description is merely exemplary rather than limiting in nature, the invention being limited only by the appended claims. Various modifications and changes may be made thereto by one of ordinary skill in the art which embody the principles of the invention and fall within the spirit and scope thereof.

What is claimed is:

1. A coil-on-plug ignition apparatus configured to be disposed in a spark plug well comprising:

a central core formed of high resistivity ferrite material;

a primary winding; and a secondary winding wound on said core having an end coupled to a connector, said connector being configured for connection to a spark plug.

2. The apparatus of claim 1 wherein said ferrite material comprises nickel zinc ferrite.

3. The apparatus of claim 1 further including a primary spool on which said primary winding is wound.

4. The apparatus of claim 3 further including an outer core outwardly of said primary winding, said central core and said outer core comprising magnetically permeable material.

5. The apparatus of claim 4 wherein said central core has an axis associated therewith, said apparatus further including a case radially inwardly of said outer core and radially outwardly of said primary winding, said case comprising electrically insulating material.

6. The apparatus of claim 1 wherein said secondary winding is segment wound.

7. The apparatus of claim 1 wherein said central core has a main axis associated therewith, said core further having an axially-extending bore in a central region of said core, said bore being filled with a secondary central core comprising compressed insulated iron particles.

8. An ignition system having a coil-on-plug ignition apparatus configured to be disposed in a spark plug well, said system comprising:

a central core extending along a longitudinal axis and being formed of ferrite material;

a secondary winding wound on said core having a first end;

a connector coupled to said first end, said connector being configured for connection to a spark plug;

a primary spool located radially outwardly of said secondary winding and in coaxial relationship with said core, said core being formed of electrical insulating material;

a primary winding disposed on said primary spool;

a case radially outwardly of said primary winding and being in coaxial relationship with said primary spool and said core, said case being formed of electrical insulating material; and an outer core formed of magnetically permeable material radially outwardly of said case.

9. The system of claim 8 wherein said secondary winding is one of a segment wound configuration and a layer wound configuration.

10. The system of claim 9 wherein said primary spool has a first inside diameter surface, said case having a second inside diameter surface, said apparatus further comprising encapsulant material disposed in (i) a first annular channel defined between said secondary winding and said first inside diameter surface, and (ii) a second annular channel defined between said primary winding and said second inside surface.

11. The system of claim 10 wherein said encapsulant comprises epoxy potting material.

12. The system of claim 8 further comprising a control circuit configured to operate said ignition apparatus to produce a plurality of sparks during a combustion event.

* * * * *